United States Patent [19]

Fuchs, Jr.

[11] Patent Number: 4,702,096

[45] Date of Patent: Oct. 27, 1987

[54] APPARATUS AND PROCESS FOR PROVIDING TUBING WITH AT LEAST ONE INTERNAL SPIRAL GROOVE OR FIN

[76] Inventor: Francis J. Fuchs, Jr., P.O. Box 10016, Naples, Fla. 33941

[21] Appl. No.: 877,215

[22] Filed: Jun. 23, 1986

[51] Int. Cl.[4] ..... B21C 37/20

[52] U.S. Cl. ..... 72/68; 72/77; 72/283; 384/613

[58] Field of Search ..... 72/68, 77, 283; 384/613

[56] References Cited

U.S. PATENT DOCUMENTS 4,135,772 1/1979 Stodt ..... 384/613

FOREIGN PATENT DOCUMENTS 163027 9/1984 Japan ..... 72/68

206512 12/1967 U.S.S.R. ..... 72/283

*Primary Examiner*—Lowell A. Larson

*Attorney, Agent, or Firm*—R. Gale Rhodes, Jr.

[57] ABSTRACT

Apparatus and process for providing the internal portion of tubing with a spiral groove or fin, or preferably a plurality of internal spiral fins, and which apparatus and process include a rotatably mounted spinner provided with one or more external ridges, which, upon relative movement of the tubing with respect to the spinner imparts rotation to the spinner causing the ridge or ridges to engage the tubing internal portion and provide at least one internal spiral groove therein; upon a plurality of external spiral ridges being provided on the spinner a plurality of internal spiral fins are formed.

19 Claims, 13 Drawing Figures

(NON LOADED)

(LOADED)

APPARATUS AND PROCESS FOR PROVIDING TUBING WITH AT LEAST ONE INTERNAL SPIRAL GROOVE OR FIN

BACKGROUND OF THE INVENTION

This invention relates generally to new and improved apparatus and process for providing the internal portion of tubing with at least one internal spiral groove, and more particularly relates to new and improved apparatus and process for providing the internal portion of tubing with at least two internal spiral grooves to provide said tubing internal portion with at least one internal spiral fin, preferably a plurality of internal spiral fins.

Tubing provided with one or more internal spiral fins is known to the art and, as is further known, such tubing typically is referred to in the art as enhanced tubing, and such enhanced tubing has many different known applications. An example of such enhanced tubing is illustrated diagrammatically in FIGS. 1 and 2 and is identified generally by numerical designation 10. Tubing 10 is provided with a plurality of internal spiral fins illustrated diagrammatically and identified by general numerical designation 12; it will be understood that the size of the fins 12 with respect to the tubing 10 has been exaggerated in FIG. 2 but such is done for the sake of clarity and ease of illustration. A well known prior art application for enhanced tubing 10 is for utilization as heat exchanger tubing with the internal spiral fins 12 providing enhanced thermal exchange between the tubing 10 and a fluid flowing therethrough such as air conditioning fluid.

Prior art apparatus and process for providing tubing 10 with internal spiral grooves 12 are illustrated diagrammatically in FIG. 3. Draw blocks or blocks 14 engage the tubing 10 and apply pulling or draw force, indicated by arrows 16, to pull or draw the tubing between a draw die 20 and a floating plug or mandrel 22. As is known to those skilled in the art, such drawing imparts rotation to the floating plug or mandrel 22 and the forward portion of the floating plug or mandrel 22 is of reduced diameter and provided with a plurality of external spiral lands or ridges 24 which engage the internal portion of the tubing 10 and form a plurality of spiral ridges therein which provide the tubing internal portion with a plurality of internal spiral fins, such as fins 12 of FIGS. 1 and 2. During such prior art drawing, as is known, considerable friction is developed between the internal portion of the tubing 10 and the spiral lands or ridges 24, such friction being identified by arrow 26, and in addition considerable friction or frictional resistance to rotation is developed between the external surface of the floating plug or mandrel 22 and the internal surface 28 of the tubing 10, such friction is indicated by arrow 29. These frictions, or frictional forces, as is known to those skilled in the art, typically do not permit the desired rotation between the floating plug or mandrel 22 and the tubing 10 which tubing does not rotate and instead moves only linearly in the direction of the drawing forces 16. This resistance to plug or mandrel rotation inhibits undesirably the drawing rate which may be achieved and further inhibits undesirably the depth of the spiral grooves, and hence the height of the internal spiral fins 12, which may be formed by this prior art apparatus and process.

Other prior art apparatus and process for providing tubing with internal spiral fins is that of swaging and shear spinning over a grooved mandrel; typically undesirably poor fin definition is achieved by this approach, and as is also known to those skilled in the art, this approach is relatively slow compared even to the above-noted prior art drawing approach illustrated diagrammatically in FIG. 3.

Accordingly, there exists a need in the art for new and mproved apparatus and process for providing the internal portion of tubing with at least one internal spiral groove, or at least one internal spiral fin, and preferably a plurality of internal spiral fins.

SUMMARY OF THE INVENTION

The primary object of the present invention is to provide new and improved apparatus and process for providing the internal portion of tubing with a spiral groove or fin, or preferably a plurality of internal spiral fins, and which apparatus and process overcome the above-noted prior art problems in this art.

Apparatus and process satisfying this object, and in accordance with the teachings of the present invention, may include a rotatably mounted spinner provided with spiral groove forming means, such as one or more external ridges, which, upon relative movement of the tubing with respect to the spinner imparts rotation to the spinner causing the spiral groove forming means, such as the ridge or ridges, to engage the tubing internal portion and provide at least one internal spiral groove therein; upon a plurality of external spiral ridges being provided on the spinner, a plurality of internal spiral grooves and thereby a plurality of internal spiral fins are provided on the internal portion of the tubing.

DESCRIPTION OF THE DRAWINGS

FIG. 7 illustrates the unloaded condition and FIG. 8 illustrates the loaded condition;

DESCRIPTION OF THE INVENTION

Figure 4:
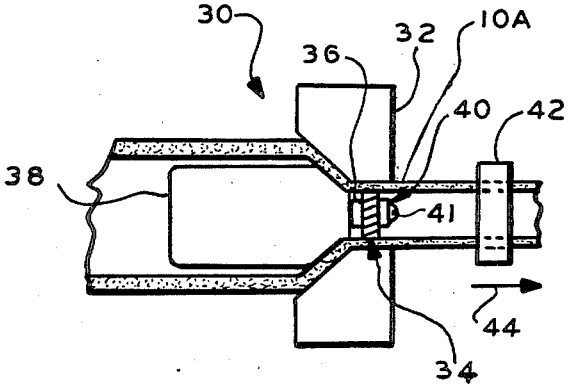
FIG. 4 is a diagrammatical illustration, generally in cross-section, of a first embodiment of the new and improved apparatus and process of the present invention.
Figure 5:
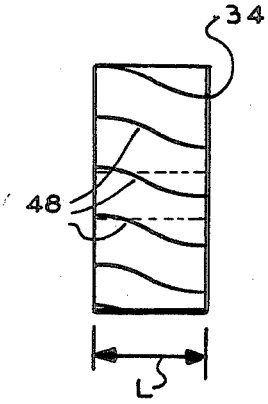
FIGS. 5 and 6 are, respectively, side elevation and end views of a spinner of the present invention provided with a plurality of external spiral ridges or lands.
Figure 6:
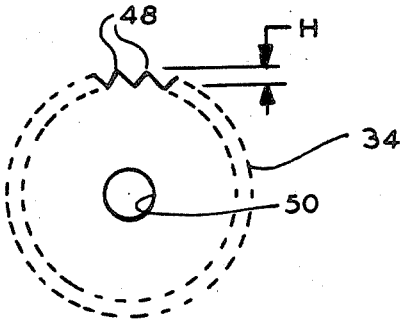

Referring now to FIG. 4, there is illustrated diagrammatically apparatus illustrated by general numerical designation 30 embodying the present invention and useful for practicing the process of the present invention. Apparatus 30 includes a draw die 32 and a spinner 34 mounted rotatably on a shaft 36 of a headed bolt 41 secured, such as by threaded engagement, with the forward portion of a floating plug or mandrel 38; more particularly it will be understood that the spinner 34 is mounted rotatably on the shaft 36 against a thrust washer 40. In this embodiment the tubing 10A is moved or drawn between the draw die 32 and floating plug or mandrel 38 by draw blocks 42 engaging the tubing 10A and applying force thereto to move the tubing 10A in the forward direction indicated by the arrow 44. As may be better understood from FIGS. 5 and 6, the spinner 34 is of generally annular shape and is provided around its cylindrical outer surface with a plurality of radially outwardly extending external spiral ridges 48; the spinner 34 is also provided with a centrally formed aperture 50 for mounting the spinner 34 rotatably on shaft 36. [As used herein, the expression "forward direction" refers to the direction of relative movement of the tubing with respect to the spinner during groove, grooves or fin forming in the tubing internal portion, and the expression "rearward direction" refers to the direction opposite to the "forward direction"; it will be understood that the spinner may be stationary and the tubing moved, or the tubing may be stationary and the spinner moved, or each may be moved, but the significant consideration is the "relative" direction of movement of the tubing with respect to the spinner.]

Upon movement of the tubing 10A by the draw blocks 42 in the forward direction, the arrow 44, the internal portion of the tubing 10A engages the spinner external spiral ridges 48 and imparts rotation to the spinner 34 to cause the spiral ridges 48 to provide the tubing internal portion with a plurality of inwardly extending spiral grooves which provide the tubing internal portion with a plurality of radially outwardly extending spiral fins comprised of tubing material extending radially outwardly between the plurality of radially inwardly extending spiral grooves.

Figure 7:
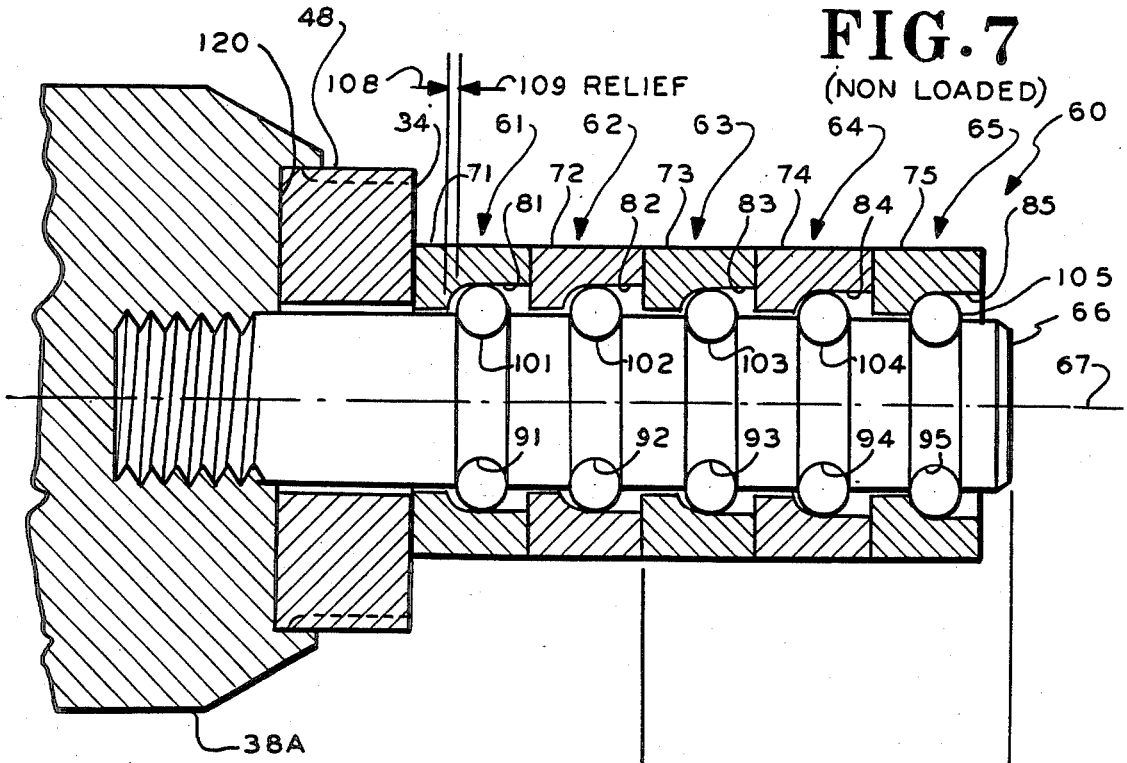
FIGS. 7 and 8 are detailed views, generally in vertical cross-section, of an alternate and preferred embodiment of the present invention.
Figure 8:
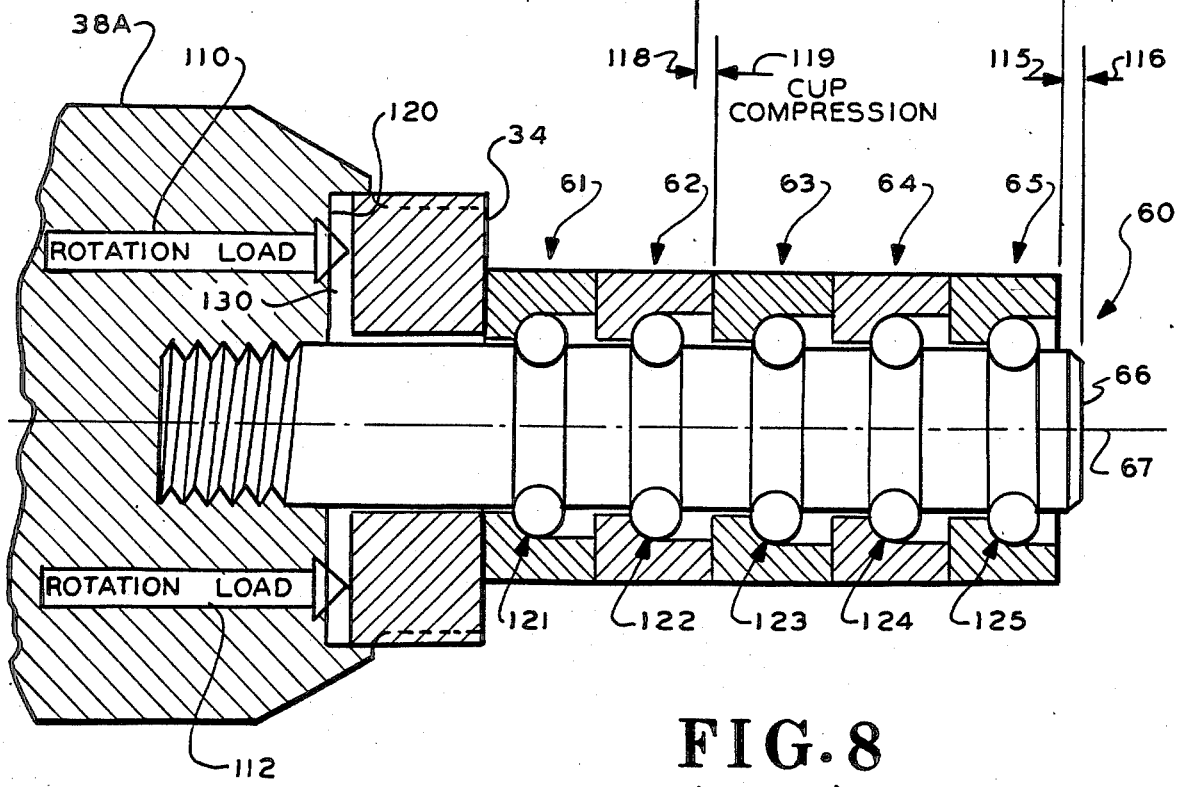

Alternatively, and preferably to mounting the spinner 34 rotatably on the shaft 36 and against the thrust washer 40, is the mounting of the spinner 34, as illustrated in FIGS. 7 and 8, rotatably on or with a multi-stage ball bearing assembly indicated by general numerical designation 60 and including a plurality of axially aligned ball bearings indicated, respectively, by general numerical designations 61–65. The assembly 60 includes a shaft 66 threadedly secured at its rearward portion to the forward portion of a floating plug or mandrel 38A and extending axially along its axis 67 in the forward direction; the shaft 66 is provided with a plurality of axially displaced, radially inwardly extending spherical grooves 91–95. Further, the assembly 60 includes a plurality of axially aligned generally annular cup-shaped members 71–75 provided, respectively, with inwardly extending recesses 81–85 extending axially in the rearward direction. The recesses 81–85 formed in the cups 71–75 provide outer ball tracks and the grooves 91–95 formed in the shaft 66 provide inner ball tracks between which roll spherical balls 101–105.

In accordance with further particular teachings of the present invention, and referring again to FIG. 7, it will be noted that the outer ball tracks comprised of the recesses 81–85 formed in the cups 71–75 are displaced axially in the rearward direction with respect to the inner ball tracks comprised of the grooves 91–95. This axial displacement provides relief space between the spherical balls and the outer ball tracks in the rearward direction with such relief space being indicated by way of example by the arrows 108 and 109 in the upward leftward portion of FIG. 7 indicating the axial relief space between the spherical ball 101 and the recess 81 in the rearward direction. In accordance with the still further particular aspects of the present invention, it will be further understood and noted from FIG. 7 that successive ones of the outer ball tracks are displaced axially with respect to the inner ball tracks increasingly greater axial distances in the rearward direction to provide increasingly greater relief space in the rearward direction between the outer ball tracks and the spherical balls which roll therein to cause the plurality of ball bearings 61–65 to assume a rotation load, imparted to the assembly 60 by the spinner 34 during fin forming, sequentially and successively in the rearward direction whereby the rotation load is assumed equally be each ball bearing; this rotation load distribution is taught in detail below in accordance with the further teachings of the present invention.

Referring now to FIGS. 7 and 8, it will be assumed that the multi-stage ball bearing assembly 60 is embodied in the apparatus 30 of FIG. 4 and has replaced the thrust washer 40 and headed bolt 41 and that the tubing 10A is being moved in the forward direction of the arrow 44 of FIG. 4 to cause the tubing inner portion to engage the spinner 34, impart rotation thereto, and provide the tubing internal portion with the internal spiral grooves and fins as taught above whereupon the spinner 34, FIG. 8, will engage and impart rotation load, indicated by arrows 110 and 112 in FIG. 8 to the assembly 60 which rotation load as indicated by the arrows 110 and 112 will act in the forward direction. It is desirable that each ball bearing of a multi-stage ball bearing assembly 60 assume or carry the same amount of rotation load as every other ball bearing in the assembly for maximum efficiency of loading and distribution of rotation loading across the assembly. This equal distribution permits a multi-stage ball bearing assembly to be smaller, less expensive and more efficient with regard to the number and depth of grooves formed than would be the case were the load distribution not to be equal across each ball bearing of the assembly. However, it has been discovered, and in accordance with the further teachings of the present invention, that were the inner and outer ball tracks to be axially aligned, and not displaced axially relative to each other, the rotation load imparted to the assembly by the rotating spinner will not be equally distributed across the ball bearings of the assembly and instead, for example, were the assembly to be comprised of only three ball bearings, the farthest ball bearing from the spinner would assume virtually no rotation load, the intermediate bearing would assume approximately one half of the rotation load assumed by the ball bearing nearest to or in engagement with the spinner whereby, in approximation, the nearest ball bearing to the spinner would assume approximately two thirds of the rotation load, the intermediate ball bearing would assume approximately one third of the rotation load, and the farthest ball bearing would assume approximately no portion of the rotation load, thereby resulting in inefficiency and in the theoretical ultimate result of the nearest ball bearing becoming overloaded and failing thereby resulting in failure of fin forming process. Accordingly, and in accordance with the further teachings of the present invention, it has been discovered that by displacing the outer ball tracks axially in the opposite direction with respect to the inner ball tracks increasingly greater axial amounts in the opposite direction, as illustrated in FIG. 7 and described above, upon the rotation load (arrows 110 and 112 of FIG. 8) being imparted to the assembly 60 by the rotating spinner 34, the ball bearings 61–65 of the assembly will assume the rotation load sequentially and successively in the axial opposite direction to cause each ball bearing to assume equal, or substantially equal, amounts of the rotation load thereby permitting the ball bearing assembly to be of smaller size, less expensive and more efficient than would otherwise be required were the inner and outer ball tracks to be axially aligned; equal loading of the ball bearings 61–65 is illustrated by the arrows 121 to 125 in the lower portion of FIG. 8 illustrating equal or uniform spherical ball contact with the outer ball tracks upon full rotation load being imparted to the assembly 60.

Still further, it has been discovered that upon the rotation load (arrows 110–112 of FIG. 8) being imparted to the assembly 60 by the rotating spinner 34, the shaft 66 is placed in tension thereby elongating axially, or tending to elongate axially in the forward direction and the cup-shaped members 71–75 are placed in compression thereby comprising axially or tending to compress axially in the forward direction. This causes, or tends to cause, further inner and outer ball track misalignment resulting in overloading, and ultimately in failure of the assembly, but, by displacing the outer ball tracks axially increasingly greater distances in the opposite direction with respect to the inner ball tracks as taught above, this tension/compression inner and outer ball track misalignment problem upon loading of the assembly is overcome. The tension/compression inner and outer ball track misalignment, or tendency, is illustrated by the vertical lines extending between corresponding structural elements shown in FIGS. 7 and 8, and particularly by arrows 115 and 116 illustrating the tension-elongation of the shaft 66 upon loading and by the arrows 118 and 119 illustrating cup compression.

It will be understood by those skilled in the art that axial displacement in the rearward direction of the outer ball tracks with respect to the inner ball tracks in accordance with the teachings of the present invention is relative axial displacement, and that such relative axial displacement may be accomplished as illustrated in FIG. 7 by providing constant axial displacement between the inner ball tracks and by displacing the outer ball tracks successively increasingly greater axial amounts in the rearward direction with respect to the inner ball tracks, or by providing constant axial displacement between the outer ball tracks and by axially displacing the inner ball tracks successively smaller axial distances in the forward direction, or combination thereof.

Referring again to FIGS. 7 and 8, a further novel aspect or feature of the present invention will be explained and understood by particular reference to the counterbore or recess 120 formed in the forward portion of the floating plug or mandrel 38A. It will be noted, and as shown in FIG. 7, that the rearward portion of the spinner 34 is received within the counterbore or recess 120 and it will be understood that the depth or axial length of the recess 120 is sufficient such that upon the rotation load (arrows 110 and 112 of FIG. 8) being imparted to the spinner 34 to displace the spinner 34 axially in the forward direction as shown in FIG. 8 (this coupled with the elongation of the shaft 66 described above), the rearward portion of the spinner 34 continues to reside within the recess 120 thereby preventing tubing material from entering the annular space 130 (FIG. 8) between the rearward portion of the spinner and the forward portion of the floating plug or mandrel 38A providing the recess 120.

Figure 9:
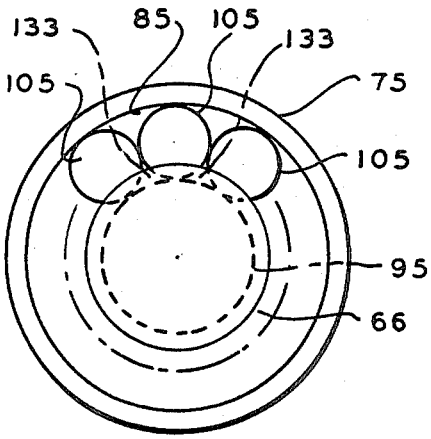
FIG. 9 is an end view of the apparatus of FIGS. 7 and 8.

However, it will be understood that upon the forming of the spiral grooves and fins in the tubing internal portion as described and illustrated above, lubricant is present between the spinner 34 and the tubing internal portion and upon the rotation load (arrows 110 and 112 of FIG. 8) being imparted to the spinner 34, the spinner 34 is displaced axially as illustrated in FIG. 8 in the forward direction, the above-noted annular space 130 will exist, or tend to exist, between the rearward portion of the rotating spinner and the forward portion of the floating plug or mandrel 38 providing the recess or counterbore 120. Lubricant pressure build-up in this annular space 130 imparts, or tends to impart, additional load to the spinner 34 causing the spinner to be displaced further axially in the forward direction thereby imparting still further rotation load to the shaft 61 and cups 71–75 and thereby further exacerbating or further comlicating the inner and outer ball track misalignment and assembly failure described above due, inter alia, to the shaft 66 being placed in tension and tending to elongate and the cups being placed in compression and tending to compress. In accordance with the further teachings of the present invention, and referring further to FIGS. 7 and 8, it will be understood that an axially extending venting passageway is provided by the present invention extending from the annular space 130 along the shaft 66 and being vented to the interior of the tubing and therethrough to the atmosphere. More particularly, it will be noted by reference to FIGS. 7 and 8 that the cup-shaped members 71–75 are provided with a centrally formed aperture larger in diameter than the shaft to provide generally annular space between the shaft and the cups; the annularly shaped spinner 34 is provided with a centrally formed aperture larger in diameter than the shaft to provide generally annular space between the shaft and the spinner; and, referring to FIG. 9, it will be noted that the spherical balls, as illustrated by spherical balls 105, are in substantially point contact with the inner track 95, the outer track 85, and with each other to provide ball spaces 133 between the spherical balls and the shaft 66. The annular spaces between the shaft 66 and the spinner 34 and the cups 71–75 and the ball spaces between the spherical balls and the shaft 66 cooperate to provide an axially extending venting passageway extending between the annular space 130 (FIG. 8) and the end of the shaft 66.

Figure 10:
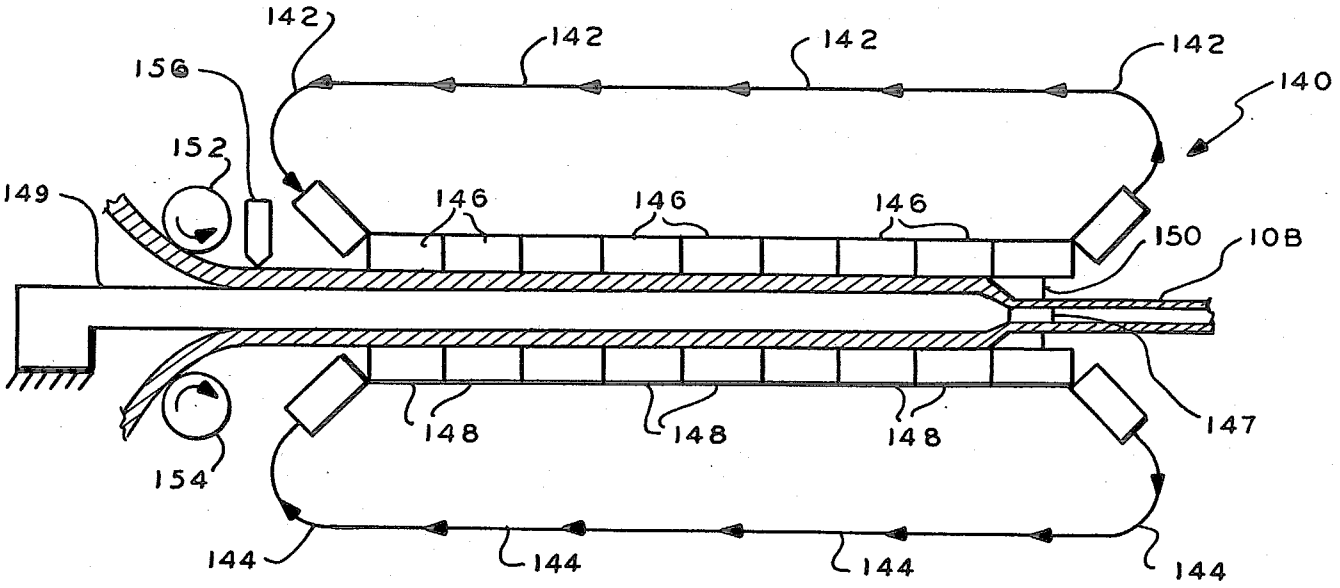
FIG. 10 is a diagrammatical illustration, generally in vertical cross-section, of a further embodiment of the present invention wherein the internal portion of tubing is provided with a plurality of internal fins continuously.
Figure 11:
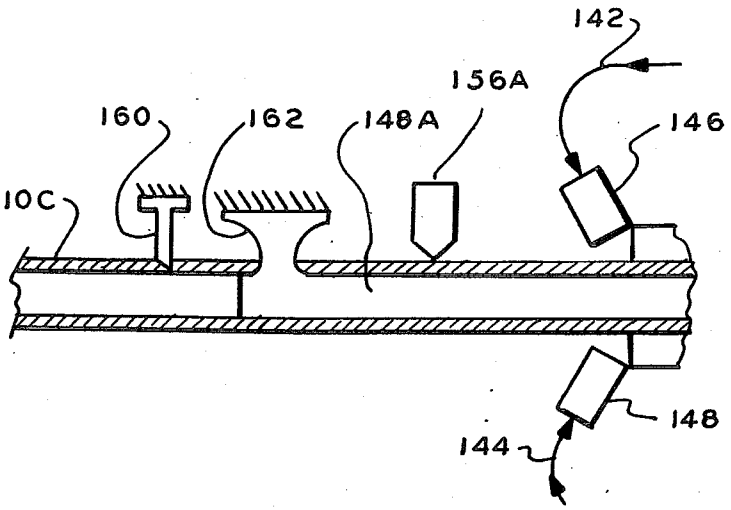
FIG. 11 is a partial view of a further alternate continuous embodiment of the present invention.

Continuous embodiments of the present invention are illustrated diagrammatically in FIGS. 10 and 11. Referring first to FIG. 10, continuous extrusion apparatus identified by numerical designation 140 is shown therein and is illustrated, diagrammatically, by elliptical groups of arrows 142 and 144 and by groups or plurality of trains of gripping element members 146 and 148 and by annular extrusion die 149 which continuous extrusion apparatus 140 may be, for example, the continuous extrusion apparatus disclosed in U.S. Pat. No. 3,740,985, issued June 26, 1973 (reissued May 4, 1976 as Re.

28,795) and U.S. Pat. No. 3,985,011 issued Oct. 12, 1976, in the name of Francis J. Fuchs, Jr. as inventor. However, it will be expressly understood by those skilled in the art that the present invention is not limited to use of any such specific continuous apparatus and may be used advantageously with other continuous extrusion apparatus known to the prior art. Apparatus 140 may further include a stationarily mounted mandrel 148 and the forward portion of the mandrel is provided with either the spinner 34 of the present invention mounted as illustrated in FIG. 4 and operated as described above, or the spinner 34 mounted as illustrated in FIGS. 7 and 8 and operated as described above. In FIG. 10 such spinner or spinners embodiments are illustrated diagrammatically by the structure indicated by general numerical designation 148. In continuous operation, it will be further understood by reference to the rearward portion of FIG. 10 that the tubing may be continuously formed around the mandrel 148 in the manner known to those skilled in the art from sheet or strip material by suitable tube forming apparatus, illustrated diagrammatically by rollers 152 and 154, and subsequently welded into continuous tubing by suitable welding apparatus indicated diagrammatically by numerical designation 156. In continuous fin forming, the trains of gripping element members surround and continuously engage the outer surface of the tubing to provide motive force thereto continuously in the forward direction to continuously move or extrude the tubing 10B between the extrusion die 149 and the spinner 148. Otherwise, the continuous apparatus of FIG. 10, and the continuous fin forming process practiced thereby, is the same as described above with regard to the embodiments of the present invention illustrated in FIG. 4 and FIGS. 7 and 8.

As illustrated diagrammatically in the partial view shown in FIG. 11, the tubing, instead of being formed from sheet or strip material as illustrated diagrammatically in FIG. 10, may be provided from a suitable source such as, for example, a continuous tubing extrusion machine such as illustrated diagrammatically in U.S. Pat. No. 4,528,832, issued July 16, 1985 in the name of Francis J. Fuchs, Jr., inventor. In this embodiment, tubing shearing or cutting apparatus, such as tubing slitter 160, may be provided rearwardly of the stationarily mounted web 162 which supports the mandrel 148 stationarily to slit the tubing 10C and permit the slit tubing to pass the web 148 whereafter, in the forward direction, the tubing is welded into continuous tubing by welding apparatus indicated diagrammatically and identified by general numerical designation 156A. Otherwise, the continuous embodiment of the present invention illustrated partially in FIG. 11 operates in the same manner as the continuous embodiment illustrated in FIG. 10 and described above.

Referring again to FIGS. 5 and 6, and with regard to a further aspect or feature of the present invention, it will be understood that the axial length L (FIG. 5) of the spinner 34 is substantially equal to less than 10 times the height H (FIG. 6) of the groove forming ridges 48 provided on the outer annular surface of the spinner 34. It has been discovered that this ratio provides enhanced groove and fin forming.

Further, and referring again particularly to FIGS. 7 and 8, it will be understood that since the drawn or extruded tubing whose internal portion is provided with the internal fin or fins is straight, substantially unlimited lengths of multi-stage ball bearing assemblies, such as assembly 60, are made possible and hence comparatively large rotation loads may be distributed equally over the ball bearings of such assemblies in accordance with the teachings set forth herein.

Figure 12:
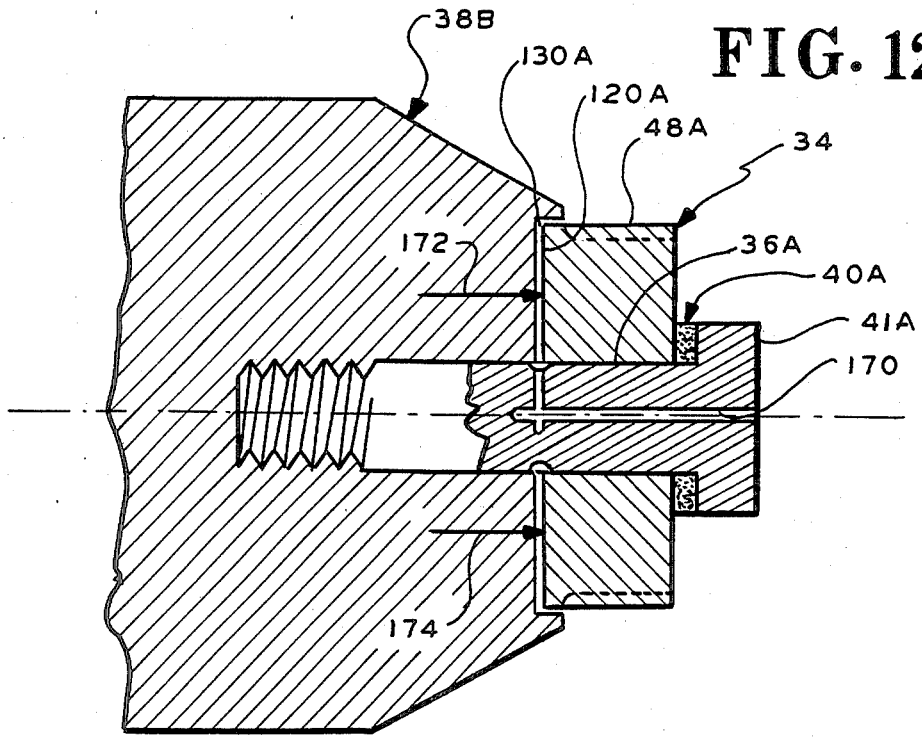
FIGS. 12 and 13 are detailed views, generally in vertical cross-section, of alternate embodiments of the present invention.

Shown in FIG. 12 is a further alternate embodiment of the present invention wherein the rearward portion of the spinner 34 is mounted in a recess 120A formed in the forward portion of the floating plug or mandrel 38B and wherein the spinner 34 is mounted rotatably on the shaft 36A of a headed bolt 41A intermediate the forward portion of the floating plug or mandrel 38B providing the recess 120A and a thrust washer 40A mounted on the shaft 36A. It will be understood that upon the forming of the spiral grooves and fins in the tubing internal portion as described and illustrated above, lubricant is present between the spinner 34A and the forward portion of the floating plug or mandrel 38B providing the recess 120A and upon rotation load indicated by arrows 172 and 174 being imparted to the spinner during internal spiral groove and fin forming in the internal portion of the tubing as noted above, the spinner is displaced axially in the forward direction and an annular space 130A will be present. Lubricant pressure build up in the space 130A imparts, or tends to impart, additional load (acting in the direction of arrows 172 and 174) to the spinner forcing the spinner into increasingly greater direct frictional engagement with the thrust washer 40A impairing the ability of the spinner to rotate and form such internal spiral fins and grooves; should such load build up become sufficiently high, the spinner can be forced into direction frictional engagement with the thrust washer with sufficient force so as to prevent rotation of the spinner. As may be noted in FIG. 12, in this embodiment the shaft 36A is provided with an internal passageway 170 extending between or communicating with the recess 120A and the forward end of the shaft which passageway vents the space 130A to the interior of the tubing and therethrough to the atmosphere thereby relieving such lubricant pressure build up.

Figure 1:
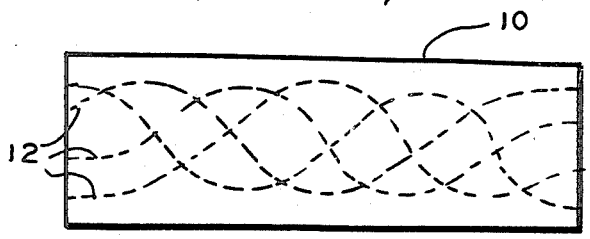
FIG. 1 (PRIOR ART)
FIGS. 1 and 2 are respectively side and end diagrammatical views of prior art enhanced tubing provided with internal spiral fins.
Figure 2:
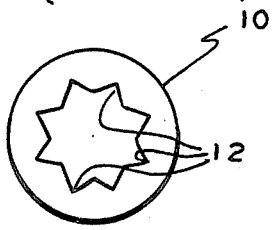
FIG. 2 (PRIOR ART)
Figure 3:
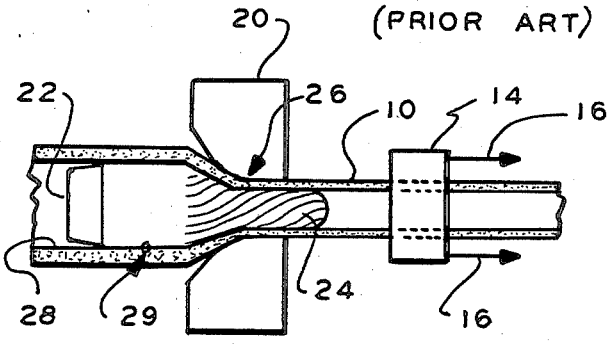
FIG. 3 (PRIOR ART)
FIG. 3 is a diagrammatical illustration, generally in cross-section, of prior art drawing apparatus and process for providing the internal portion of tubing with internal spiral fins.
Figure 13:
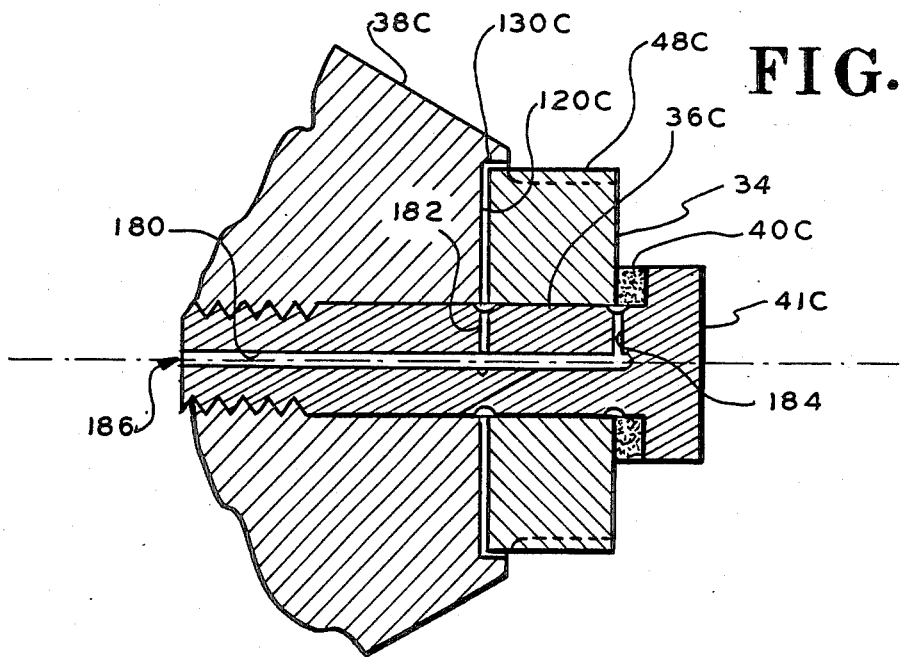

A still further alternate embodiment of the present invention for reducing the frictional forces during internal spiral groove and fin forming and an internal portion of the tubing is illustrated in FIG. 13. In this embodiment, a hydrostatic bearing is provided for providing pressurized fluid between the rearward portion of the spinner 34 and the forward portion of the floating plug or mandrel 38C providing the recess 120C and between the spinner 34 and the thrust washer 40C mounted on the shaft 36C of the headed bolt 41C. The hydrostatic bearing comprises an internal passageway 180, including interconnecting passageways 182 and 184, formed internally of the floating plug or mandrel 38C and connected at its rearward portion 186 to a suitable supply of pressurized fluid (not shown) which pressurized fluid, during internal spiral groove and fin forming, is communicated by the passageway 180 between the rearward portion of the spinner 34 and the forward portion of the floating plug or mandrel 38C providing the recess 120C and between the spinner 34 and the thrust washer 40C. The presence of the pressurized fluid prevents direct mechanical frictional engagement between the spinner 34 and the forward end of the floating plug or mandrel 38C and between the spinner 34 and the thrust washer 40C thereby facilitating rotation of the spinner during forming of the noted internal spiral groove and fins in the internal portion of the tubing and thereby facilitating forming of the spiral groove(s) without interruption and to a greater depth than permitted by the prior art and hence facilitates the forming of internal spiral fins of a greater height than permitted by the prior art apparatus and process described above and shown in FIG. 3. Still further, alternatively, a hydrostatic bearing for the spinner 34 may be provided by plugging the rearward portion of the passageway 180 thereby placing passageways 182 and 184 in communication whereby upon lubricant pressure build up in annular space 130C the pressurized lubricant is communicated from annular space 130C to between the spinner and the thrust washer 40C to achieve the hydrostatic bearing described above.

It will be understood by those skilled in the art that many modifications and variations of the present invention may be made without departing from the spirit and the scope thereof.

What is claimed is:

1. Apparatus for providing the internal portion of tubing with at least two internal spiral grooves to provide said tubing internal portion with at least one internal spiral fin, comprising:

spinner means provided with at least two external spiral ridges;

mounting means for mounting said spinner means rotatably, said spinner means and said mounting means for being positioned internally of said tubing, said mounting means including an internal tube forming member for residing internally of said tubing and having a forward portion provided with a recess complementary in shape to said spinner means and said recess for receiving a predetermined rearward portion of said spinner means, said mounting means including a headed bolt having a shaft including a rearward portion secured to the forward portion of said internal tube forming member and a thrust washer mounting on said shaft, said spinner means mounted rotatably on said shaft intermediate said forward portion of said internal tube forming member providing said recess and said thrust washer with said spinner means rearward portion received in said recess, and said mounting means including a hydrostatic bearing for preventing direct frictional engagement between said spinner means and said forward portion of said internal tube forming member providing said recess and between said spinner means and said thrust washer; and upon relative movement of said tubing with respect to said spinner means in a predetermined direction, said internal portion of said tubing engaging said spiral ridges and imparting rotation to said spinner means to cause said spiral ridges to provide said tubing internal portion with said internal spiral grooves.

2. Apparatus according to claim 1 wherein said hydrostatic bearing comprises an internal passageway extending through said internal tube forming member and for communicating pressurized fluid between said rearward portion of said spinner means and said forward portion of said internal tube forming member providing said recess and between said spinner means and said thrust washer.

3. Apparatus according to claim 1 wherein said spinner means is of generally annular shape and has an axis wherein said ridges have a predetermined height and wherein said spinner means has an axial length substantially equal to less than ten times said height.

4. Apparatus according to claim 1 wherein said apparatus further includes a die having a centrally formed aperture for receiving said spinner means in spaced apart relationship and wherein said tubing moves between said spinner means and said die during providing of said internal spiral grooves.

5. Apparatus according to claim 4 wherein said apparatus further includes movement means for providing said relative movement.

6. Apparatus according to claim 5 wherein said movement means comprise draw blocks for engaging and moving said tubing.

7. Apparatus according to claim 5 wherein said relative movement is continuous and wherein said movement means comprise a plurality of trains of gripping element members for surrounding and continuously engaging the outer surface of said tubing to provide motive force thereto continuously in said predetermined direction to continuously provide said relative movement.

8. Apparatus for providing the internal portion of tubing with at least two internal spiral grooves to provide said tubing internal portion with at least one internal spiral fin, comprising:

spinner means provided with at least two external spiral ridges;

mounting means for mounting said spinner means rotatably, said spinner means and said mounting means for being positioned internally of said tubing;

upon relative movement of said tubing with respect to said spinner means in a predetermined direction, said internal portion of said tubing engaging said spiral ridges and imparting rotation to said spinner means to cause said spiral ridges to provide said tubing internal portion with said internal spiral grooves and said spiral fin; and said mounting means including a multi-stage ball bearing assembly having an axis extending in said predetermined direction and including a plurality of axially aligned ball bearings, each ball bearing including inner and outer ball tracks and a plurality of spherical balls which roll between said ball tracks, predetermined ones of said outer ball tracks displaced axially with respect to said inner ball tracks in the opposite direction to said predetermined direction to provide relief space in said opposite direction between said predetermined outer ball tracks and the spherical balls which roll therein, upon said rotation being imparted to said spinner means said spinner means engaging and imparting rotation load in said predetermined direction to said multi-stage ball bearing assembly and said axial displacement of said outer ball tracks with respect to said inner ball tracks distributing said rotation load substantially equally between said ball bearings.

9. Apparatus according to claim 8 wherein successive ones of said outer ball tracks are displaced axially with respect to said inner ball tracks increasingly greater axial distances in said opposite direction to provide increasingly greater relief space in said opposite direction between said predetermined outer ball tracks and the spherical balls which roll therein for causing said plurality of ball bearings to assume said rotation load sequentially and successively in said opposite direction.

10. Apparatus according to claim 9 wherein said multi-stage ball bearing assembly comprises a cylindrical shaft having said axis, said shaft provided with a plurality of axially displaced, inwardly extending, spherical grooves comprising said inner ball tracks; and a plurality of axially aligned, generally annular cup-shaped members surrounding said shaft, each cup-shaped member provided with a centrally formed aperture and an axially inwardly extending recess extending axially inwardly in said opposite direction, said recesses providing said outer ball tracks.

11. Apparatus according to claim 10 wherein said inwardly extending recesses extend inwardly increasingly greater amounts successively in said opposite direction.

12. Apparatus for providing the internal portion of tubing with at least two internal spiral grooves to provide said tubing internal portion with at least one internal spiral fin, comprising:

spinner means provided with at least two external spiral ridges;

mounting means for mounting said spinner means rotatably, said spinner means and said mounting means for being positioned internally of said tubing;

upon relative movement of said tubing with respect to said spinner means in a predetermined direction, said internal portion of said tubing engaging said spiral ridges and imparting rotation to said spinner means to cause said spiral ridges to provide said tubing internal portion with said internal spiral grooves and said spiral fin; and said mounting means include an internal tube forming member for residing internally of said tubing and having a forward portion, said forward portion provided with a recess complementary in shape to said spinner means and said recess for receiving a predetermined rearward portion of said spinner means to prevent build-up of tubing material between the forward portion of said internal tube forming member and said rearward portion of said spinner means during providing of said grooves.

13. Apparatus according to claim 12 wherein said internal tube forming member is a floating plug.

14. Apparatus according to claim 12 wherein said internal tube forming member is a stationarily mounted mandrel.

15. Apparatus for providing the internal portion of tubing with at least one internal spiral groove, comprising:

spinner means provided with spiral groove forming means;

mounting means for mounting said spinner means rotatably, said spinner means and said mounting means for being positioned internally of said tubing;

upon relative movement of said tubing with respect to said spinner means in a predetermined direction, said internal portion of said tubing engaging said groove forming means and imparting rotation to said spinner means to cause said groove forming means to provide said tubing internal portion with said internal spiral groove; and said mounting means include an internal tube forming member for residing internally of said tubing and having a forward portion provided with a recess complementary in shape to said spinner means and said recess for receiving a predetermined rearward portion of said spinner means, upon providing of said groove lubricant being present between said spinner means and said internal portion of said tubing and present between said rearward portion of said spinner means and said forward portion of said internal tube forming member, and wherein said mounting means provides venting means for preventing lubricant pressure buildup between said rearward portion of said spinner means and said forward portion of said internal tube forming member.

16. Apparatus according to claim 15 wherein said mounting means include a multi-stage ball bearing assembly including a cylindrical shaft having an axis extending in said predetermined direction and secured to the forward portion of said internal tube forming member, said shaft provided with a plurality of axially displaced, inwardly extending, spherical grooves providing inner ball tracks, a plurality of axially aligned, generally annular cup-shaped members surrounding said shaft, each cup-shaped member provided with a centrally formed aperture larger in diameter than said shaft to provide a first generally annular space between said shaft and cup, and each cup provided with an inwardly extending recess extending in the direction opposite to said predetermined direction, said recesses providing outer ball tracks, and a plurality of spherical balls which roll between said tracks, and wherein said spinner means is generally annularly shaped and provided with a centrally formed aperture larger in diameter than said shaft to provide a second generally annular space between said shaft and said spinner means, wherein said spinner means surrounds said shaft intermediate said forward portion of said internal tube forming member and said multi-stage ball bearing assembly, wherein said ball bearings are in substantially point contact with said tracks and each other to provide ball spaces between said balls and said shaft, and wherein said first and second annular spaces and said ball spaces cooperatively provide a generally axial venting passageway extending through said mounting means between said complementary recess and the end of said shaft and comprising said venting means.

17. Apparatus according to claim 15 wherein said mounting means include a headed bolt having a shaft including a rearward portion secured to the forward portion of said internal tube forming member and a thrust washer mounted on said shaft, wherein said spinner means is mounted rotatably on said shaft intermediate said forward portion of said internal tube forming member and said thrust washer with said spinner means rearward portion received within said recess, wherein said shaft has a forward end and wherein said shaft is provided with an internal passageway extending between said complementary recess and the forward end of said shaft and comprising said venting means.

18. Process of providing the internal portion of tubing with at least two internal spiral grooves, to provide said tubing internal portion with at least one internal spiral fin, comprising the steps of:

mounting rotatably spinner means provided with at least two external spiral ridges;

providing relative movement of said tubing with respect to said spinner means in a predetermined direction to cause said tubing to engage said external ridges and impart rotation to said spinner means and to cause said external ridges to engage said tubing internal portion to form said internal spiral grooves and said internal spiral fin therein;

mounting said spinner means on a multi-stage ball bearing assembly including a plurality of axially aligned ball bearings, each ball bearing including inner and outer ball tracks and a plurality of spherical balls which roll between said tracks;

upon said tubing engaging said external ridges and imparting rotation to said spinner means, said spinner means engaging and imparting rotation load to said multi-stage ball bearing assembly; and displacing predetermined successive ones of said outer ball tracks increasingly greater axial distances with respect to said inner ball tracks in said opposite direction to provide increasingly greater relief space in said opposite direction between said predetermined successive ones of said ball tracks and the spherical balls which roll therein to cause said ball bearings to assume said rotation load sequentially and successively in said opposite direction.

19. Process of providing the internal portion of tubing with at least one internal spiral groove, comprising the steps of:

mounting rotatably spinner means provided with spiral groove forming means;

providing relative movement of said tubing with respect to said spinner means in a predetermined direction to cause said tubing to engage and impart rotation to said spinner means and to cause said groove forming means to engage said tubing internal portion to form said internal spiral groove therein; and said mounting means including an internal tube forming member for residing internally of said tubing and having a forward portion provided with a recess complementary in shape to said spinner means and said recess for receiving a predetermined rearward portion of said spinner means, upon said forming of said groove lubricant being present between said spinner means and said internal portion of said tubing and present between said rearward portion of said spinner means and said forward portion of said internal tube forming member, and said process including the further step of venting the space between said predetermined rearward portion of said spinner means and said forward portion of said internal tube forming member to prevent lubricant pressure build-up between said rearward portion of said spinner means and said forward portion of said internal tube forming member during providing of said groove.

* * * * *